US006523181B2

(12) United States Patent
Medves

(10) Patent No.: US 6,523,181 B2
(45) Date of Patent: Feb. 25, 2003

(54) PROTECTIVE GAUNTLET AND GARMENT

(75) Inventor: Steven A. Medves, Cary, IL (US)

(73) Assignee: Standard Safety Equipment Company, McHenry, IL (US)

( * ) Notice: Subject to any disclaimer, the term of this patent is extended or adjusted under 35 U.S.C. 154(b) by 0 days.

(21) Appl. No.: 09/872,606

(22) Filed: Jun. 1, 2001

(65) Prior Publication Data

US 2002/0178485 A1 Dec. 5, 2002

(51) Int. Cl.[7] ..... A41D 19/00
(52) U.S. Cl. ..... 2/161.6; 2/16; 2/160
(58) Field of Search ..... 2/16, 2, 160, 161.1, 2/162, 170, 161.7, 124, 125, 126, 59; 15/227

(56) References Cited

U.S. PATENT DOCUMENTS 2,082,574 A * 6/1937 Handley ..... 2/161.1
2,655,663 A 10/1953 Hoaglund
3,747,126 A 7/1973 Hoaglund
4,388,733 A * 6/1983 Anstett ..... 2/161
4,399,567 A * 8/1983 Weon Joong ..... 2/161
4,984,299 A * 1/1991 Halldorsdottir ..... 2/16
5,070,544 A * 12/1991 Aliberti et al. ..... 2/170
5,682,616 A * 11/1997 Pisano ..... 2/239
5,924,130 A * 7/1999 Fragomeli ..... 2/16
5,953,756 A * 9/1999 Vrissimdjis ..... 2/168

* cited by examiner

*Primary Examiner*—John J. Calvert
*Assistant Examiner*—Katherine Moran
(74) *Attorney, Agent, or Firm*—Wood, Phillips, Katz, Clark & Mortimer

(57) ABSTRACT

A protective gauntlet connectable to a sleeve of a protective garment (and a garment secured to a gauntlet), including a protective flexible glove member including a cuff, a stiff cuff member disposed inside the cuff, the glove member cuff and the cuff member being securable in an end of the garment sleeve, and a collar having a small end and a large end. The collar small end is impermeably secured at one end about the glove member and the collar large end projects over at least a portion of the glove member cuff and the cuff member without connecting to the sleeve.

11 Claims, 1 Drawing Sheet

PROTECTIVE GAUNTLET AND GARMENT

BACKGROUND OF THE INVENTION

This invention is directed toward protective garments, and particularly toward protective gauntlets which may be worn when working with or handling corrosive chemicals, gases, impure liquids such as dirty water, or the like.

Protective gauntlets for use by workers to protect their hands are well known in the art. Particularly for workers in toxic and corrosive environments, such gauntlets may be a part of an overall protective suit which protects the entire user's body. Gauntlets of that type are shown, for example, in U.S. Pat. Nos. 2,655,663 and 3,747,126, which include a stiffened frusto-conical insert behind the wrist portion of the glove member, where the stiffened portion is thrust through a lesser diameter opening in a sleeve of the garment for obtaining a tight seal between the sleeve and the gauntlet, while still leaving the ability to remove the gauntlet from the garment sleeve.

Of course, too tight of a connection can make it difficult to remove the gauntlet from the sleeve. Further, even the tightest of such a connection may cause the wearer some concern should they be in an environment where dangerous materials might be directed at pressure toward that connection from the area of the glove member. A wearer in such an environment may be concerned, for example, that the dangerous material may force its way under the end of the sleeve opening and work its way between the sleeve and the gauntlet into the interior of the gauntlet and protective suit.

In the prior art, such concerns have been addressed informally by the wearer by adding their own "seal", such as duct tape around the sleeve opening and the glove member. However, such "seals" appear to be what they are—"makeshift" additions to a garment—and therefore do not necessarily inspire additional confidence to the wearer (who may believe, for example, that the tape is an insufficient repair to some hole covered thereby). Further, as such "seals" wear (e.g., from repeated bending during use) their worn appearance may additionally cause the wearer to lose confidence in the safety of the protection provided by the suit and/or gauntlet. Such lost confidence can cause a gauntlet to be unnecessarily discarded even though it is still perfectly suitable for safe use.

Beyond the confidence factor, the addition of a tape adhesive obviously interferes with the desired ability to remove the gauntlet from the sleeve. Further, such tape could conceivably itself be a factor in causing the flexible glove member to degrade in some way, whether through some kind of reaction with the adhesive or as a result of unplanned physical stresses on the glove member. For example, when the wearer bends his wrist inside the gauntlet, the bending point of the glove member will usually be different when stiff tape has been added which extends beyond the cuff assembly of the gauntlet as originally designed. This can not only cause the glove to be uncomfortable (e.g., by rubbing against the wearer's hand or hand at places), but can also make the gauntlet more difficult to use due to the additional, undesirable and undesigned stiffness beyond the cuff assembly.

The present invention is directed toward overcoming one or more of the problems set forth above.

SUMMARY OF THE INVENTION

In one aspect of the present invention, a protective gauntlet is provided which is connectable to a sleeve of a protective garment to protect a wearer from environmental hazzards, including a protective flexible glove member including a cuff, a stiff cuff member disposed inside the cuff, the glove member cuff and the cuff member being securable in an end of the garment sleeve, and a collar having a small end and a large end. The collar small end is impermeably secured at one end about the glove member and the collar large end projects over at least a portion of the glove member cuff and the cuff member without connecting to the sleeve.

In one form, the collar large end extends beyond the end of the garment sleeve. In another form, the cuff member is substantially a truncated cone and, in yet another form, the collar is substantially a truncated cone.

In another aspect of the present invention, a garment for protecting a wearer from environmental hazzards is provided, including a protective flexible glove member including a cuff, a stiff cuff member disposed inside the cuff, a protective sleeve including an elastic end portion tightly disposed around the glove member cuff to define a stiff cuff assembly with the cuff member, and a collar having a small end and a large end. The collar small end is impermeably secured at one end about the glove member and the collar large end projects over the end of the sleeve elastic end portion without connecting to the sleeve.

Previously described forms of the first aspect of the present invention may also be used with this aspect of the invention.

In still another aspect of the present invention, a protective garment is provided including an impermeable flexible glove member including a wrist portion between a first cuff and a hand enclosing portion, a stiff cuff member disposed inside the first cuff, an impermeable sleeve including an elastic end portion tightly disposed around the first cuff to define a stiff cuff assembly, and a collar impermeably secured at one end about the glove member wrist portion. The other collar end projects over the end of the impermeable sleeve adjacent the glove member wrist portion without connecting to the impermeable sleeve.

In one form, the first cuff includes a lip at an end distal from the glove member, where the lip is adapted to abut an end of the stiff cuff member to retain the first cuff on the stiff cuff member. In another form, the collar is secured to the glove member wrist portion by PVC tape.

DETAILED DESCRIPTION OF THE INVENTION

Figure 1:
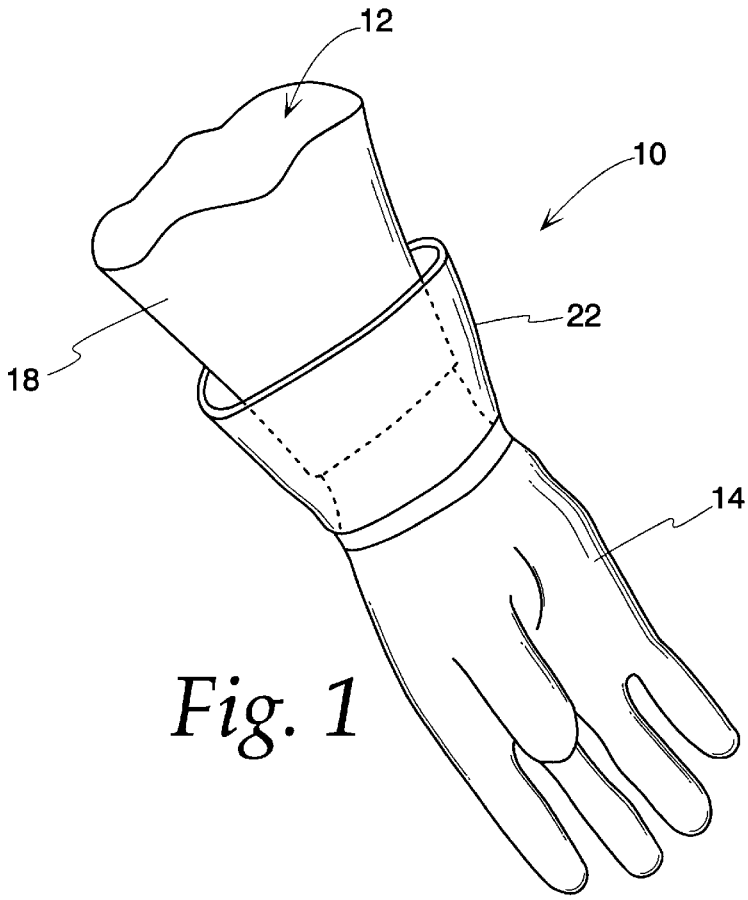
FIG. 1 is a perspective view of a protective gauntlet according to the present invention.

A protective gauntlet 10 secured to a part of a garment 12 according to the present invention is shown in FIG. 1. The gauntlet 10 includes an impermeable flexible glove member 14 and is shown connected to an impermeable sleeve 18 of the garment 12 as discussed below with respect to FIG. 2. A collar 22 is impermeably secured (e.g. by PVC tape such as shown at 24) about one end to the wrist portion of the glove member 14 (i.e., a portion of the glove member 14 spaced from the finger and thumb openings), with its other end projecting over the end of the impermeable sleeve 18 without being connected to the impermeable sleeve 18.

It should be understood that "impermeable" as used herein is intended to refer to the ability of the material of the component to prevent an intended class of possibly harmful materials from passing through the material. For example, the glove member 14 may be made of suitable rubber material to protect the wearer's hand. However, if rubber would not provide suitable protection against a particular class of materials with which the gauntlet 10 is intended to be used, a different material suitable for use with that class of materials could also be used. Of course, a maximally protective material could be used when the gauntlet 10 is intended to be used in an environment having highly toxic materials.

Figure 2:
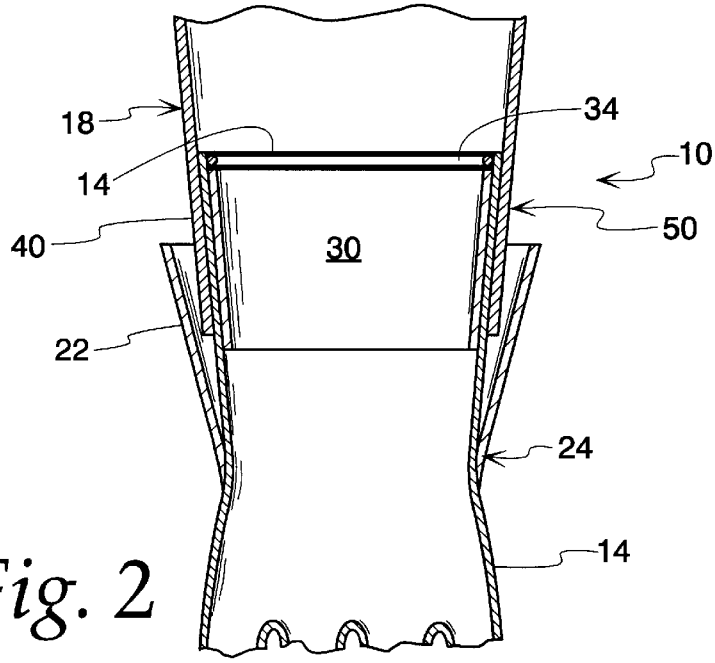
FIG. 2 is a cross-sectional view of a portion of the protective gauntlet of FIG. 1.

FIG. 2 shows the connection of the glove member 14 to the sleeve 18. Specifically, a stiff cuff member 30, which can be in a frusto-conical shape, is disposed inside of the rear (cuff) portion of the glove member 14. The rear (cuff) portion is adapted to fit relatively tightly around the cuff member 30, and may include a lip member 34 at its end which will abut the rear end of the cuff member 30 to assist in retaining the glove member 14 on the cuff member 30.

The sleeve 18 includes at its forward end an elastic portion 40 which is stretched over the glove member rear (cuff) portion to form a stiff and sealed cuff assembly 50 generally at a wearer's wrist. For example, elastically stretching the elastic portion 40 so that it is tightly around the rear (cuff) portion of the glove member 14 provides a substantially impermeable shield against any material passing therethrough.

Such a stiff cuff assembly 50 provides protection to the wearer's wrist. Further, it allows the wearer to grasp the assembly 50 for pulling off the gauntlet 10, without requiring that the glove member 14 (which is more likely to be covered with hazardous materials) be grasped for removing the gauntlet 10 and also provides a backing for the frictional and elastic connection between the sleeve 18 and the glove member 14 such as discussed in connection with the prior art. Such a connection, however, has the many potential disadvantages previously discussed (e.g., wearer concern re possible leak through the connection, and possible makeshift solutions such as duct tape with their attendant problems). In accordance with the present invention, the collar 22 can be seen to provide an excellent barrier against any pressurized materials which may be directed toward the end of the cuff assembly 50 from the area of the glove member 14. Further, the collar 22 will provide adequate space so that the gauntlet may be removably secured to the garment sleeve (not essentially permanently attached as would occur with duct tape, the removal of which could well damage the gauntlet and/or sleeve and potentially require one or both to be discarded, or dangerously used if such damage is not noticed). Still further,, keeping the collar 22 free of connection to the cuff assembly ensures that the designed flexibility of the gauntlet 10 (and particularly the glove member 14) will not be hindered.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A protective gauntlet connectable to a sleeve of a protective garment to protect a wearer from environmental hazzards, comprising:

a protective flexible glove member including a cuff;

a stiff cuff member disposed inside said cuff, said glove member cuff and said cuff member being securable in an end of the garment sleeve; and a collar having a small end and a large end, said collar small end being impermeably secured at one end about said glove member and said collar large end projecting over at least a portion of said glove member cuff and said cuff member without connecting to said sleeve.

2. The protective gauntlet of claim 1, wherein said collar large end extends beyond said end of said garment sleeve.

3. The protective gauntlet of claim 1, wherein said cuff member is substantially a truncated cone.

4. The protective gauntlet of claim 1, wherein said collar is substantially a truncated cone.

5. A garment for protecting a wearer from environmental-hazzards, comprising:

a protective-flexible glove member including a cuff;

a stiff cuff member disposed inside said cuff;

a protective sleeve including an elastic end portion tightly disposed around said glove member cuff to define a stiff cuff assembly with said cuff member; and a collar having a small end and a large end, said collar small end being impermeably secured at one end about said glove member and said collar large end projecting over the end of said sleeve elastic end portion without connecting to said sleeve.

6. The protective garment of claim 5, wherein said collar large end extends beyond said end of said garment sleeve.

7. The protective garment of claim 5, wherein said cuff member is substantially a truncated cone.

8. The protective garment of claim 5, wherein said collar is substantially a truncated cone.

9. A protective garment for protecting a wearer from environmental hazzards, comprising:

an impermeable flexible glove member including a wrist portion between a first cuff and a hand enclosing portion;

a stiff cuff member disposed inside said first cuff;

an impermeable sleeve including an elastic end portion tightly disposed around said first cuff to define a stiff cuff assembly; and a collar impermeably secured at one end about said glove member wrist portion, said other collar end projecting over the end of said impermeable sleeve adjacent said glove member wrist portion without connecting to said impermeable sleeve.

10. A protective garment for protecting a wearer from environmental hazzards, comprising:

an impermeable flexible glove member including a wrist portion between a first cuff and a hand enclosing portion;

a stiff cuff member disposed inside said first cuff;

an impermeable sleeve including an elastic end portion tightly disposed around said first cuff to define a stiff cuff assembly; and a collar impermeably secured at one end about said glove member wrist portion, said other collar end projecting over the end of said impermeable sleeve adjacent said glove member wrist portion without connecting to said impermeable sleeve;

wherein said first cuff includes a lip at an end distal from said glove member, said lip adapted to abut an end of said stiff cuff member to retain said first cuff on said stiff cuff member.

11. A protective garment for protecting a wearer from environmental hazzards, comprising:

an impermeable flexible glove member including a wrist portion between a first cuff and a hand enclosing portion;

a stiff cuff member disposed inside said first cuff;

an impermeable sleeve including an elastic end portion tightly disposed around said first cuff to define a stiff cuff assembly; and a collar impermeably secured at one end about said glove member wrist portion, said other collar end projecting over the end of said impermeable sleeve adjacent said glove member wrist portion without connecting to said impermeable sleeve, wherein said collar is secured to said glove member wrist portion by PVC tape.

* * * * *